United States Patent [19]

Bodine

[11] Patent Number: 4,913,234

[45] **Date of Patent: * Apr. 3, 1990**

[54] FLUID DRIVEN SCREW TYPE SONIC OSCILLATOR-AMPLIFIER SYSTEM FOR USE IN FREEING A STUCK PIPE

[76] Inventor: Albert G. Bodine, 7877 Woodley Ave., Van Nuys, Calif. 91406

[ * ] Notice: The portion of the term of this patent subsequent to Apr. 25, 2006 has been disclaimed.

[21] Appl. No.: 299,392

[22] Filed: Jan. 19, 1989

Related U.S. Application Data

[63] Continuation-in-part of Ser. No. 78,282, Jul. 27, 1987, Pat. No. 4,824,258.

[51] Int. Cl.[4] ..... E21B 31/16

[52] U.S. Cl. ..... 166/301; 175/56; 366/120

[58] Field of Search ..... 166/301; 175/55, 56; 366/117, 118, 119, 120, 123, 124, 125, 128, 241, 600; 415/502

[56] References Cited

U.S. PATENT DOCUMENTS

| | | | |
|---|---|---|---|
| 2,479,799 | 8/1949 | Wilde | 259/1 R |
| 3,076,513 | 2/1963 | Heaphy | 175/55 |
| 3,155,163 | 11/1964 | Bodine, Jr. | 166/301 |
| 3,168,140 | 2/1965 | Bodine, Jr. | 175/56 |
| 3,567,185 | 3/1971 | Ross et al. | 259/1 R |
| 3,633,688 | 1/1972 | Bodine | 175/56 X |
| 3,746,310 | 7/1973 | Fransson et al. | 259/1 R |
| 3,903,000 | 9/1975 | Miura et al. | 210/251 |
| 3,975,120 | 8/1976 | Tschicky | 418/48 |
| 4,261,425 | 4/1981 | Bodine | 175/106 |
| 4,271,915 | 6/1981 | Bodine | 175/56 |
| 4,293,231 | 10/1981 | Sule | 366/120 |
| 4,667,742 | 5/1987 | Bodine | 166/301 |

*Primary Examiner*—William P. Neuder
*Attorney, Agent, or Firm*—Edward A. Sokolski

[57] ABSTRACT

A Moyno type oscillator having a screw shaped rotor and stator is lowered down by means of a cable within a section of drill pile which has become stuck in a bore hole. The rotor of the oscillator is rotatably driven by means of a liquid stream at a speed such as to generate vibrational energy in the oscillator housing at a sonic frequency. The cable from which the oscillator is suspended has swivel bearings installed therein to permit the oscillator housing to rotate from the cable. The vibrational energy generated in the oscillator housing causes the housing to rotate precessionally around the inside wall of the stuck section of drill pipe to thus generate amplified lateral quadrature vibrational energy in the drill pipe to shake it loose from the bore hole.

9 Claims, 3 Drawing Sheets

FLUID DRIVEN SCREW TYPE SONIC OSCILLATOR-AMPLIFIER SYSTEM FOR USE IN FREEING A STUCK PIPE

This application is a continuation-in-part of my application Ser. No. 078,282 filed July 27, 1987 now U.S. Pat. No. 4,824,258.

This invention relates to oil well servicing and more particularly to a method and apparatus for sonically freeing a section of pipe string which has become stuck in a well.

In working with an oil well, a section of pipe string on occasion becomes stuck in the well bore making it impossible to continue the operation involved. A proven technique, described in prior art patents such as my U.S. Pat. No. 4,667,742 issued May 26, 1987 and certain of the prior arts cited in that patent, for freeing a section of pipe string from a well bore is the application of sonic energy to the pipe string at vibration frequencies of about 10–100 Hz, such energy preferably being applied down-hole close to the point at which the string is stuck. It has been found highly desirable to apply such energy in a lateral quadrature vibration mode.

The use of a fluid driven screw type (Moyno) sonic oscillator which is lowered down into the well as a "fishing tool" is described in my application Ser. No. 078,282 of which the present application is a continuation-in-part. As described in connection with FIGS. 3 and 4 of this prior application, the lower end of the oscillator housing is threadably attached to the stuck section of pipe and the oscillator then operated to provide the lateral quadrature sonic energy to the pipe to effect the loosening thereof from the well bore, in the same general manner as described in my U.S. Pat. No. 4,667,742.

The use of swivel bearings in supporting a sonic oscillator for rotatably driving a drill bit around a borehole is known in the art, as, for example, described in U.S. Pat. No. 3,049,185 to Herbold. In the systems of such prior art patents, however, no amplification of the internal oscillator's vibratory force is achieved by causing the oscillator housing to roll around the inner wall of a pipe, as in the present invention.

In the system of my application Ser. No. 078,282 the force of the cyclic impulse which generates said lateral quadrature sonic energy is first initiated by the mass and orbital eccentricity of the screw shaped rotor within the (Moyno) sonic oscillator. In this type of system, the oscillator must have a fairly substantial outside diameter in order that its internally embodied screw shaped rotor will be large enough so as to have enough mass and orbiting radius to generate substantial cyclic quadrature force. This diameter requirement limits the oscillator placement in the pipe string. Typically, the upper major portion of the pipe string has to be removed from the well so that the oscillator can be installed at some point down along the string such as by threaded attachment to the pipe string as described in my aforementioned application. This dismantling and removal of upper pipe string length with the necessary additional operation of installing the oscillator can be a costly procedure.

The system of the present invention provides a great advantage in that the oscillator can be slid down in place in the pipe string immediately when the pipe gets stuck, and without requiring typical operations such as shooting off the pipe string, pulling out the long upper string section, and the round trip operation involved in reinstalling the string.

The feature of the present invention which makes possible the immediate application of cycloidal sonic energy to free the pipe is that now the oscillator can be quite slender so as to be slidable down inside the pipe while still providing a strong cyclic quadrature force output. This is because the system of the invention provides a force amplifying effect which increases the force determined by the mass and eccentricity of the slender internal rotor. This is accomplished by having in effect a roller within a roller combination. The slender screw shaped moyno rotor functions as the inner roller, and the heavy housing of the oscillator driven by this internal screw rotor then functions as the outer roller which in turn rolls around the inside of the stuck pipe. Thus, an amplifying or force step up function is engendered by the more forceful cycloidal action of the total oscillator housing which makes possible the employment of a slender oscillator which will go inside of the stuck pipe without dismantling the latter.

In carrying out the invention, suspension bearing means is provided which supports the oscillator housing for free rotation within the stuck pipe. Bearing means is also provided to support the screw shaped rotor freely within the housing so that said rotor may assume a phase angle which is conducive to effectively roll the housing vibratorily inside of said stuck pipe.

The system is thus arranged by means of a roller within a roller function to provide a leverage effect with improved acoustical impedance matching between the high fluid flow current and the desired high cyclic force acting against the stuck pipe. A very slender tool having the convenience of quick and easy installation is thus a major attribute of this invention.

The system of the present invention thus is an improvement over the "fishing tool" embodiment of my aforementioned prior application in that rather than attaching the housing of the oscillator to the stuck pipe section, the oscillator housing is made rather slender so that it can be placed within the drill pipe and caused to roll or precess around on the inside surface thereof in response to the sonic energy. The lateral quadrature sonic energy is in this manner thus transferred to the stuck section of pipe thereby enabling the pipe to be shaken loose from the well bore. The system of the present invention as described affords a substantial amplification of the vibration force over that of my prior application in that the entire oscillator (including its housing) becomes the orbiting mass which mass has a large orbiting radius by virtue of its precessional motion around the inside surface of the drill pipe.

In carrying out the invention, a Moyno oscillator having a screw shaped rotor and stator is lowered down within the stuck section of pipe and the rotor of the oscillator rotatably driven by means of a liquid stream. The cable from which the oscillator is suspended has swivel bearings installed therein to permit rotation of the oscillator housing precessionally around the inside wall of the stuck section of pipe in response to the vibrational energy generated within the oscillator housing. The lateral quadrature vibrational energy is transferred to the pipe to effectively shake the pipe loose from the bore hole wall.

It is therefore an object of this invention to provide an improved method and apparatus for freeing a section of well pipe which has become stuck in a bore hole.

It is another object of this invention to amplify the cyclic force output of a screw type sonic oscillator by causing the entire oscillator housing to precess about on the internal surface of a pipe.

It is a further object of this invention to provide a method and apparatus which effectively amplifies sonic energy for transmission to a pipe string to shake such string loose from a bore hole in which it has become lodged.

Other objects of the invention will become apparent as the description proceeds in connection with the accompanying drawings of which:

Figure 1A:
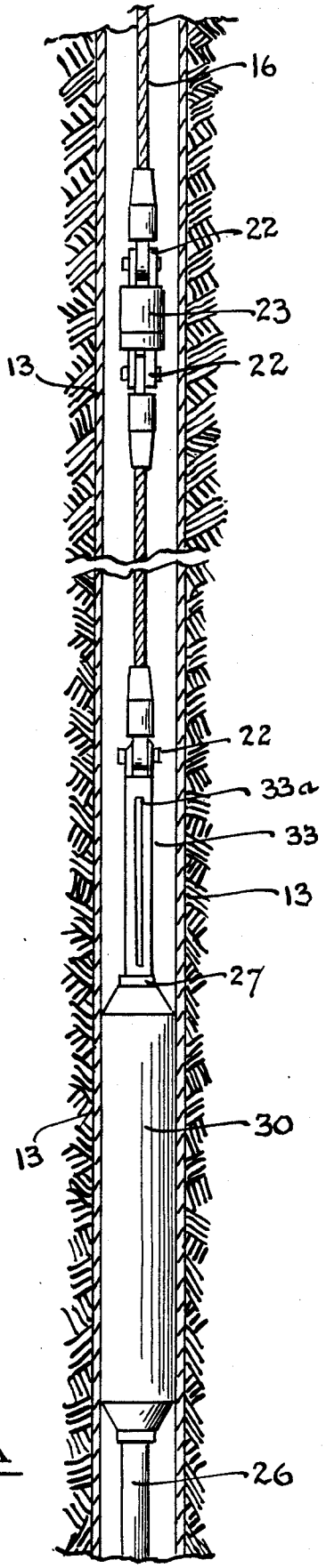
FIGS. 1A and 1B are elevational views illustrating a preferred embodiment of the invention.
Figure 1B:
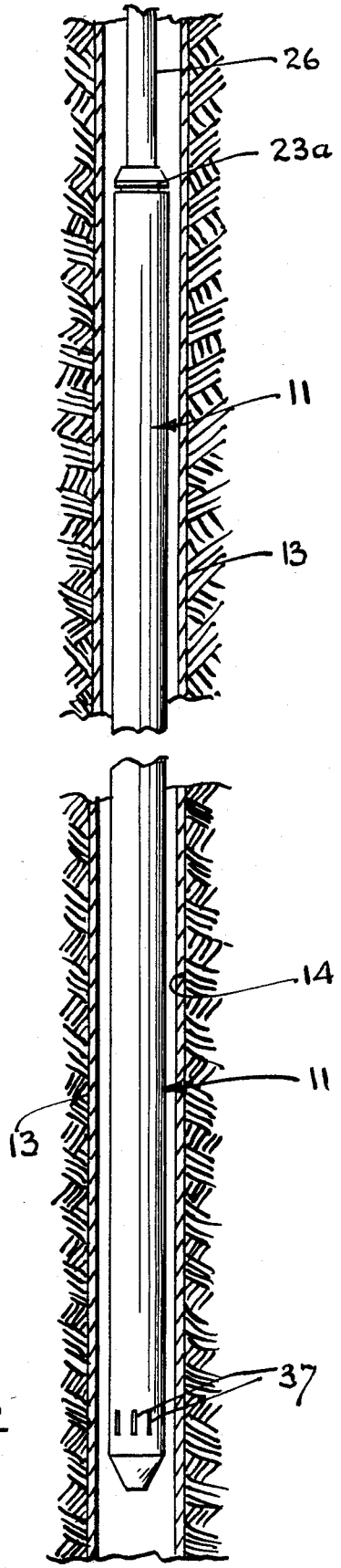
Figure 2A:
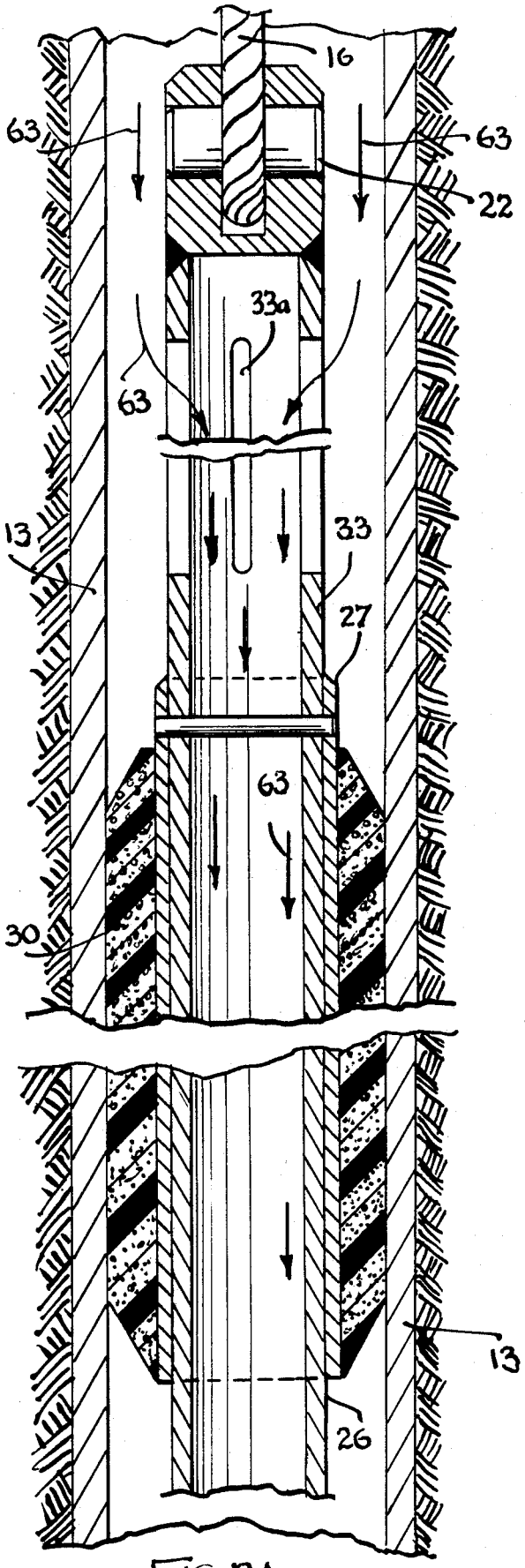
FIG. 2A is a cross sectional view an elevation illustrating part of the suspension mechanism employed in the system of the invention.
Figure 2B:
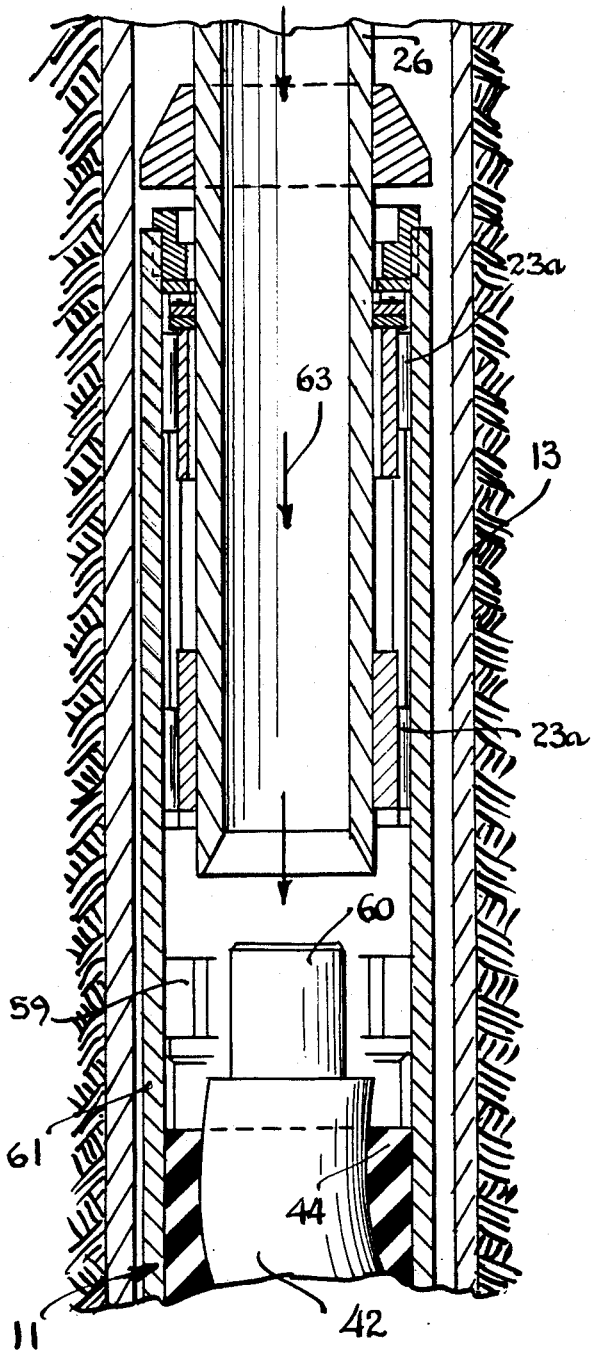
FIGS. 2B and 2C are cross sectional views in elevation illustrating a preferred embodiment of the oscillator employed in the system of the invention.
Figure 2C:
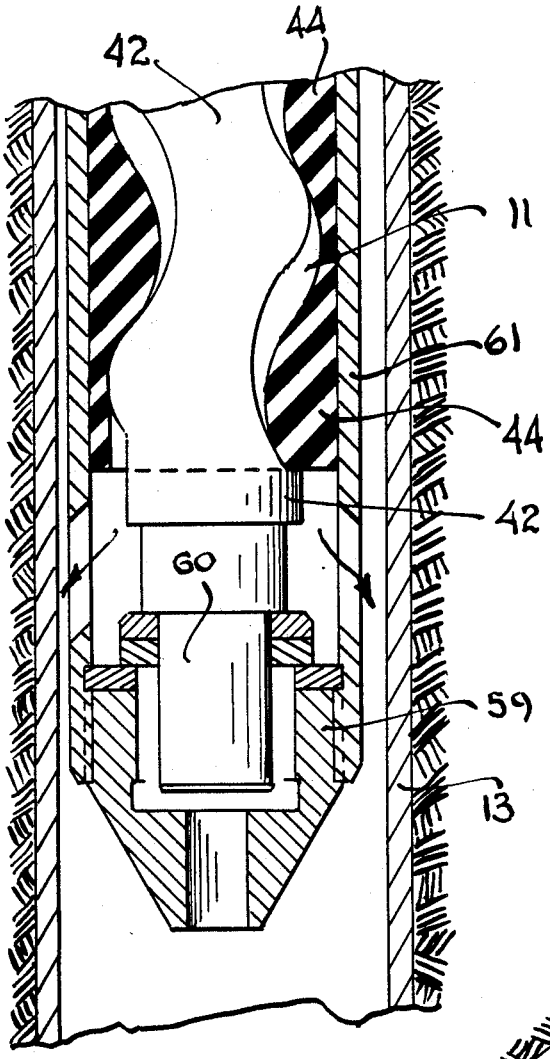

Referring particularly to FIGS. 1A and 1B, oscillator 11 is suspended within pipe string 13 at a location in said pipe where the pipe has become stuck in the bore hole 14. Oscillator 11 is freely suspended within pipe 13, the outside diameter of the oscillator housing being substantially less than the inside diameter of pipe 13. The oscillator is suspended from cable 16, which has swivel joints 22 installed therein and ball bearing rotary swivels 23 and **23*a* which along with resilient packer gland 30 facilitate lateral and rotary motion of the oscillator. Attached to the top end of the housing of oscillator 11 are a first narrower tube section 26 which has some flexibility and wider tube section 27. Tube section 26 has a length such that at the frequency of oscillator operation it functions as a vibrational isolator. This end result can be further achieved by making the tube length such that it functions as a quarter wave resonant line so that high amplitude vibration at the lower end of the line is translated into low amplitude vibration at the upper end of the line, which is attached to tube section 27. Tube section 27 has a packer gland 30 molded thereto, this packer gland being of a plastic material such as polyurethane. This gland blocks the mud stream, which drives the oscillator, from flowing along the sides of the pipe so that such mud stream rather flows to within pipe section 33 through slots 33*a* and thence through pipe sections 27 and 26 to the oscillator. Rotary bearing 23*a* is provided between pipe section 26 and the oscillator to facilitate rotation of the oscillator to assure that packer gland 30 does not rotate therewith. Outlet ports 37** are provided at the bottom of the oscillator housing to permit the outflow of the mud stream after it has performed its function in driving the oscillator rotor, as to be described in connection with FIGS. 2A–2C and 3.

Referring now to FIGS. 2A–2C and 3, a portion of the suspension mechanism and the oscillator of the preferred embodiment of the invention are illustrated. The oscillator 11 is of the Moyno type having a screw shaped rotor 42 which is rotatably driven on a screw shaped stator 44 by means of a liquid stream. This oscillator is fully described in my aforementioned application Ser. No. 078,282, the disclosure of which is incorporated herein by reference. Rotor 42 is typically made of a metal such as steel while stator 44 is of a resilient material such as a suitable rubber or synthetic elastomeric material. Bearing races 59 are provided in the housing 61 around which roller members 60 which are attached to the opposite ends of rotor 42, can ride.

A liquid mud stream as indicated by arrows 63 is fed down drill string pipe 13 and travels through slots **33*a* in pipe section 33 to the interior of the pipe and thence down to the oscillator. As already noted, the passage of this stream along the outside of the pipe is prevented by means of packing gland 30. The liquid stream rotatably drives rotor 42 around on stator 44 to generate lateral quadrature vibratory forces in the housing 61** of the oscillator. Typically, the vibrational energy developed is in the range of 10–100 Hz.

Figure 3:
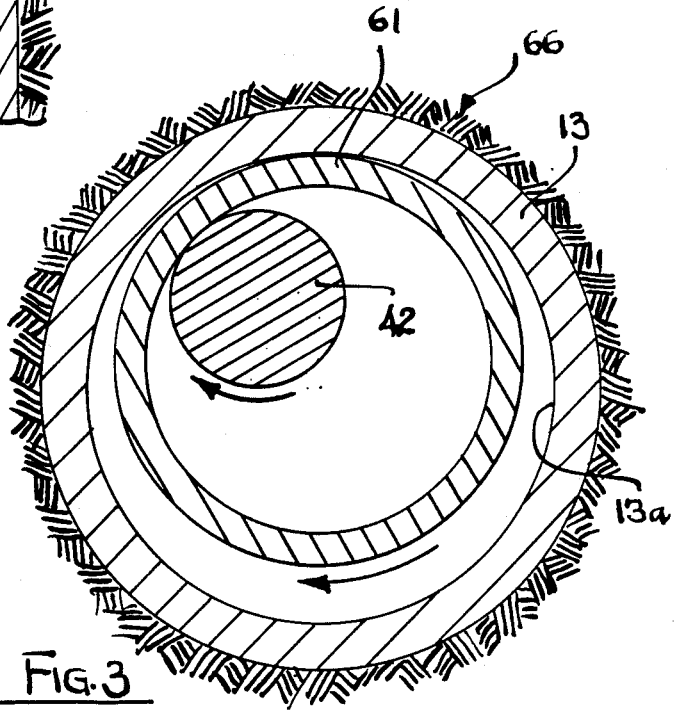
FIG. 3 is a schematic cross sectional view illustrating the operation of the system of the invention.

As schematically illustrated in FIG. 3, the vibratory energy generated by virtue of the rotation of rotor 42 causes the oscillator to precess around on the inside surface **13*a* of the pipe 13, this precessional rotation being at the oscillator vibration frequency. The forces so generated effect lateral quadrature vibration of pipe 13 which is highly effective in loosening such pipe from the surrounding earthen material 66** in which the pipe has become lodged.

It is to be noted that the oscillator is free to rotate on its suspension support by virtue of bearing **23*a*. This rotary bearing tends to prevent any rotary motion from being transferred up the pipe section 26 to the location of packer gland 30. However, should there be any tendency for rotation at this point, rotary bearing 23, installed in cable 16**, isolates any such rotary motion from the upper parts of the cable.

While the invention has been described and illustrated in detail, it is to be clearly understood that this is intended by way of illustration and example only and is not to be taken by way of limitation, the spirit and scope of the invention being limited only by the terms of the following claims.

I claim:

1. A system for providing sonic vibrational energy to effect the freeing of a section of well pipe stuck in a well bore comprising:

an orbital oscillator including a housing;

an elongated screw shaped stator mounted in said housing and an elongated screw shaped rotor mounted for precessionally rolling rotation freely in said stator;

means for suspending said oscillator for rotation within said section of pipe about the longitudinal axis of the drill pipe in close proximity to the stuck portion thereof; and drive means for rotatably driving said rotor to effect orbital lateral sonic vibration of said housing such that said housing precesses laterally around the inner wall of said pipe, thereby generating lateral quadrature vibrational forces in said pipe to effect the freeing thereof from said well bore.

2. The system of claim 1 wherein the means for rotatably driving the rotor comprises a fluid stream, a fluid inlet being formed at one end of said housing and a fluid outlet being formed at the other end of said housing, said fluid stream being fed into said fluid inlet at a predetermined flow rate.

3. The system of claim 2 and further including a section of pipe attached to said oscillator housing and suspended within said well pipe above said oscillator housing having a fluid inlet therein and packing gland means installed between the fluid inlet of said section of pipe and said oscillator for preventing the fluid stream from passing between the outer wall of the section of pipe and the inner wall of said well pipe.

4. The system of claim 1 wherein said means for suspending said oscillator comprises a cable and swivel bearings installed in said cable to permit the rotation of the oscillator.

5. A system for providing sonic vibrational energy to a load comprising:

an orbital oscillator including a housing, an elongated screw shaped stator mounted in said housing and an elongated screw shaped rotor mounted for precessionally rolling rotation freely in said stator;

a fluid inlet formed in one end of said housing;

a fluid outlet formed in the end of said housing opposite said one end thereof;

means for supporting said housing;

liquid drive means fed into said fluid inlet and exited from said fluid output for rotatably driving said freely mounted rotor at a rolling precessional speed such as to effect orbital lateral sonic vibration of said housing; and bearing means interconnected between said housing and said means for supporting said housing in such manner that said housing is free to rotate about the longitudinal axis thereof;

substantially the entire extent of said housing being coupled to said load to transfer said sonic vibration thereto through contact between the housing and the load;

said rotor drive means and said means for supporting said housing being coupled to said rotor and said housing respectively so as to effect minimal constraint to the lateral vibration of said housing.

6. A system for providing sonic vibrational energy to a load comprising:

an orbital oscillator including a housing, an elongated screw shaped stator mounted in said housing and an elongated screw shaped rotor mounted for precessionally rolling rotation freely in said stator;

a fluid inlet formed in one end of said housing;

a fluid outlet formed in the end of said housing opposite said one end thereof;

means for supporting said housing;

liquid drive means fed into said fluid inlet and exited from said fluid output for rotatably driving said freely mounted rotor at a rolling precessional speed such as to effect orbital lateral sonic vibration of said housing; and bearing means interconnected between said housing and said means for supporting said housing such that said housing is free to rotate about the longitudinal axis thereof;

said rotor drive means and said means for supporting said housing being coupled to said rotor and said housing respectively so as to effect minimal constraint to the lateral vibration of said housing.

7. A system for providing sonic vibrational energy to a load comprising:

an orbital oscillator including a housing, an elongated screw shaped stator mounted in said housing and an elongated screw shaped rotor mounted for precessionally rolling rotation freely in said stator;

a fluid inlet formed in one end of said housing;

a fluid outlet formed in the end of said housing opposite said one end thereof;

means for supporting said housing;

liquid drive means fed into said fluid inlet and exited from said fluid outlet for rotatably driving said freely mounted rotor at a rolling precessional speed which generates cyclic force such as to effect orbital lateral sonic vibration of said housing; and bearing means interconnected between said housing and said means for supporting said housing such that said housing is free to rotate about the longitudinal axis thereof;

said orbital sonic vibration of said housing generating vibrational force which is amplified in relation to the cyclic force generated by said precessional rolling of said screw shaped rotor.

8. A method for freeing a section of pipe stuck in a bore hole comprising the steps of:

suspending an orbital oscillator having a housing and a rotor within said pipe for rotation of the housing around the inner wall of said pipe;

lowering said oscillator within said drill string to the vicinity where the drill string is stuck; and driving the rotor of said oscillator so as to generate lateral quadrature vibrational energy within said housing and to effect precessional rotation of said housing around the inner wall of the drill string, thereby shaking the drill string loose from the well bore.

9. The method of claim 8 wherein said oscillator has a screw type rotor and screw type stator and wherein the rotor is driven by a liquid stream which is fed thereto at one end thereof and exited therefrom at the other end thereof.

* * * * *